US012253289B2

(12) United States Patent
Dunn et al.

(10) Patent No.: US 12,253,289 B2
(45) Date of Patent: Mar. 18, 2025

(54) SERIALLY ARRANGED CIRCULATING CRYOCOOLER SYSTEM

(71) Applicant: Sumitomo (SHI) Cryogenics of America, Inc., Allentown, PA (US)

(72) Inventors: Stephen B. Dunn, Bethlehem, PA (US); Santhosh K. Gandla, Allentown, PA (US)

(73) Assignee: SUMITOMO (SHI) CRYGENICS OF AMERICA, INC., Allentown, PA (US)

( * ) Notice: Subject to any disclaimer, the term of this patent is extended or adjusted under 35 U.S.C. 154(b) by 0 days.

(21) Appl. No.: 17/874,781

(22) Filed: Jul. 27, 2022

(65) Prior Publication Data

US 2023/0033344 A1 Feb. 2, 2023

Related U.S. Application Data

(60) Provisional application No. 63/226,851, filed on Jul. 29, 2021.

(51) Int. Cl.
*F25B 9/14* (2006.01)
*F25B 1/00* (2006.01)
(Continued)

(52) U.S. Cl.
CPC ..... *F25B 9/14* (2013.01); *F25B 1/005* (2013.01); *F25B 41/20* (2021.01); *F25B 41/45* (2021.01);
(Continued)

(58) Field of Classification Search
CPC .. F25B 9/14; F25B 41/20; F25B 41/45; F25B 1/005; F25B 49/02; F25B 2309/001; F25B 2309/1428; F25B 2600/2507
See application file for complete search history.

(56) References Cited

U.S. PATENT DOCUMENTS 5,889,456 A 3/1999 Triebe et al.
6,347,522 B1 2/2002 Maguire et al.
(Continued)

FOREIGN PATENT DOCUMENTS

CN 103033000 A 4/2013
CN 103808056 A 5/2014
(Continued)

OTHER PUBLICATIONS

International Search Report and Written Opinion of the International Searching Authority dated Nov. 18, 2022, from the corresponding International Application No. PCT/US2022/038473.
(Continued)

*Primary Examiner* — Nael N Babaa
(74) *Attorney, Agent, or Firm* — KATTEN MUCHIN ROSENMAN LLP

(57) ABSTRACT

A circulating loop for transporting refrigeration to a remote location is connected serially between a Gifford-McMahon (GM) or GM type Pulse Tube cold head and the compressor. Either high pressure gas from the compressor can flow through the remote heat station before returning to the cold head or low pressure gas can flow from the cold head to the remote heat station before returning to the compressor. A first fraction of gas, which may include all of the gas at ambient temperature, enters a counter-flow heat exchanger, is cooled by the cold head, flows to the remote load, and then returns to ambient temperature as it flows through the counter-flow heat exchanger. The high or low pressure line may have a circulation control valve that diverts a second fraction of gas to flow directly between the cold head and compressor. A controller adjusts the circulation control valve to optimize the cooling of the load.

15 Claims, 3 Drawing Sheets

(51) Int. Cl.

| | |
|---|---|
| ***F25B 41/20*** | (2021.01) |
| ***F25B 41/45*** | (2021.01) |
| ***F25B 49/02*** | (2006.01) |

(52) U.S. Cl.

CPC ..... *F25B 49/02* (2013.01); *F25B 2309/001* (2013.01); *F25B 2309/1428* (2013.01); *F25B 2600/2507* (2013.01)

(56) References Cited

U.S. PATENT DOCUMENTS

| | | | |
|---|---|---|---|
| 6,923,009 | B2 | 8/2005 | Kudaravalli |
| 7,003,977 | B2 | 2/2006 | Steinbach et al. |
| 7,474,099 | B2 | 1/2009 | Boesel et al. |
| 9,612,062 | B2 | 4/2017 | Zui et al. |
| 10,704,809 | B2 | 7/2020 | Longsworth et al. |
| 2006/0097146 | A1 | 5/2006 | Strobel |
| 2015/0176867 | A1 | 6/2015 | Longsworth |
| 2019/0316813 | A1 | 10/2019 | Longsworth et al. |
| 2021/0025624 | A1 | 1/2021 | Li et al. |

FOREIGN PATENT DOCUMENTS

| | | | |
|---|---|---|---|
| GB | 2433581 | B | 2/2008 |
| JP | H02251055 | A | 10/1990 |
| JP | 2003519772 | A | 6/2003 |
| JP | 2008027780 | A | 2/2008 |
| JP | 5380310 | B2 | 1/2014 |
| JP | 2014119174 | A | 6/2014 |
| JP | 2017166747 | A | 9/2017 |
| JP | 2020515038 | A | 5/2020 |
| WO | 0151863 | A1 | 7/2001 |
| WO | 2018118019 | A1 | 6/2018 |

OTHER PUBLICATIONS

Notice of Reasons for Rejection issued Dec. 24, 2024, from Japanese Patent Application No. 2024-505309, 6 sheets.

SERIALLY ARRANGED CIRCULATING CRYOCOOLER SYSTEM

CROSS REFERENCE TO RELATED APPLICATIONS

This application claims the priority of U.S. Provisional Application Ser. No. 63/226,851, filed on Jul. 29, 2021, which is hereby incorporated herein by reference in its entirety.

BACKGROUND

1. Field of the Invention

This invention relates to cooling of loads remote from a Gifford-McMahon (GM) or GM type pulse tube cold head (expander).

2. Description of Related Art

Valved, regenerative-cycle cryogenic refrigerators (cryocoolers) such as Gifford-McMahon (GM) or pulse tube cryocoolers are popular for providing cryogenic refrigeration for refrigeration loads smaller than 1 kW due to their relative efficiency, compact size, and relative low cost. These cryocoolers are defined by having a compressor that provides high-pressure gas to a cold head and receives low-pressure gas from the cold head; the cold head containing a valve that cycles gas to a reciprocating displacer that transfers gas between warm and cold displaced volumes through a regenerator. A disadvantage of this type of cryocooler is that the refrigeration provided is only available at a cold surface located on the cold head. Unlike a Brayton cycle expander which discharges cold gas at low pressure that can circulate to a remote load, these regenerative type expanders return the low pressure gas at room temperature. To overcome this disadvantage, systems have been developed that combine regenerative cycle cryocoolers with fluid-containing loops that transport the refrigeration by circulating cooled fluid from the cold head cold surface to a location remote from the cold head. A gas is used as the fluid in such a loop when the refrigeration is needed over a broad temperature range or when characteristics of the cooled object preclude cooling with a liquid or a with a liquid-to-gas phase change. In this case, the refrigeration is transported by the sensible heat of the gas as its temperature is lowered (cooled) in one part of the loop and its temperature is raised (warmed) in another part of the loop.

Two types of circulating loops using gas as the circulating fluid have been described. One type, having a cold circulator, has the entire circulating loop at the cold temperature, including the mechanism that moves the cold fluid through the loop. The other type, having a warm circulator, has a portion of the loop containing the cold head and remote load at the cold temperature and a portion containing the mechanism that moves the fluid at warm temperature (e.g. room temperature or above). Between the two portions and in the loop is a recuperative style heat exchanger that allows the cold portion of the loop to operate at temperatures significantly lower than the circulator temperature. The recuperative style heat exchanger cools the fluid coming from the circulator and warms the fluid returning to the circulator.

Examples of systems having a cold circulator are described in U.S. Pat. No. 6,347,522, GB patent No. 2,433,581, and numerous technical papers such as "Cryogenic Thermal Studies on Cryocooler-Based Helium Circulation Systems for Gas Cooled Superconducting Power Devices," Kim, et. al., Cryocoolers 18. U.S. Pat. No. 10,704,809 describes a system with GM expanders having a cold circulator and a means to use it to cool or warm a remote load. In these systems the circulating loop is separate from the cryocooler so that they do not share or exchange fluid. A variation of a system with a cold circulating mechanism that does share and exchange fluid with the cryocooler is described in "Performance Test of Pulse Tube Cooler with Integrated Circulator," Maddocks, et. al., Cryocoolers 16. In this variation, the circulating fluid originates from and exhausts to the inside of the cold surface of the cryocooler; the fluid being moved by the cryocooler internal pressure swing rectified into a DC flow by check valves.

Examples of systems having a warm circulator are described in U.S. Pat. Nos. 5,889,456 and 9,612,062, and in technical paper "Remote Helium Cooling Loops for Laboratory Applications," Trollier, et. al., Cryocoolers 17. U.S. Pat. No. 7,003,977 describes a circulation system having cold storage components that can have either warm or cold circulators. In these examples, the cryocooler and circulating loop are separate as describe above. Examples of systems with a warm circulator where the circulating loop and cryocooler share and exchange fluid are described in U.S. Pat. No. 7,474,099 and technical paper "Remote Cooling with the HEC Cooler," Michaelian, et. al., Cryocoolers 15. U.S. patent application publication No. 2021/0025624 describes circulating a fraction of the compressor flow using ejectors to increase the cold flow rate to a remote load. In these examples, one compressor is used for both the cold head and the circulating loop with the circulating loop being arranged in parallel with the cold head. An example of a system with a warm circulator where the cryocooler is replaced by a heat exchanger cooled by an expendable cryogenic fluid is described in U.S. Pat. No. 6,923,009.

What is not taught by these previous disclosures and is disclosed as this present invention is a system where the circulating loop and cryocooler share and exchange fluid, and the circulating loop is in a serial flow arrangement with the warm intake or exhaust of the cryocooler cold head.

SUMMARY

A circulating loop for transporting refrigeration to a remote location is connected serially between a GM or GM type Pulse Tube cold head and the compressor. A fraction, or all, of the gas flowing between the compressor and cold head is diverted to be cooled by the cold head then cool a remote load before returning to rejoin the fraction that flows directly to or from the cold head. Either high pressure gas from the compressor can flow through the remote heat station before returning to the cold head (expander) or low pressure gas can flow from the cold head to the remote heat station before returning to the compressor. Circulating gas flows through a counter-flow heat exchanger located between the lines connected to the cold head and compressor, which are at ambient temperature, and the cold surface or surfaces of the cold head and the remote load. A line through which gas flows directly to or from the compressor may have a circulation control valve that diverts the flow to the circulation loop and controls the pressure drop that drives the flow through the circulating loop. A controller with input from various sensors adjusts the circulation control valve to optimize the cooling of the load. The gas that circulates to the load is referred to as the first fraction and the balance of the gas that flows directly between the compressor and cold head is referred to as the second fraction.

The circulating loop may contain elements such as isolating valves, adsorbent, charge and vent ports, bayonets and vacuum jacketed transfer lines, and heaters to support functions of cooling a remote load to cryogenic temperatures and warming it back to room temperature.

These advantages and others are achieved, for example, by a cryogenic refrigeration system that circulates gas to a remote load. The cryogenic refrigeration system comprises a compressor compressing a gas from a low pressure to a high pressure, at least one Gifford-McMahon (GM) or GM type pulse tube cold head receiving gas at ambient temperature from said compressor in a line at high pressure and returning the gas in a line at low pressure, producing refrigeration at one or more cold surfaces of the GM or GM type pulse tube, and a circulation loop through which all or a fraction of said gas in one of said lines at high pressure and low pressure flow. The circulation loop transports the refrigeration from said one or more cold surfaces to the remote load. These advantages and others are achieved, for example, by a method for adjusting the circulation control valve to control the cooling of the remote load.

BRIEF DESCRIPTION OF THE DRAWINGS

The drawing figures depict one or more implementations in accord with the present invention, by way of example only, not by way of limitations. In the figures, like reference numerals refer to the same or similar elements.

DETAILED DESCRIPTION

Figure 1:
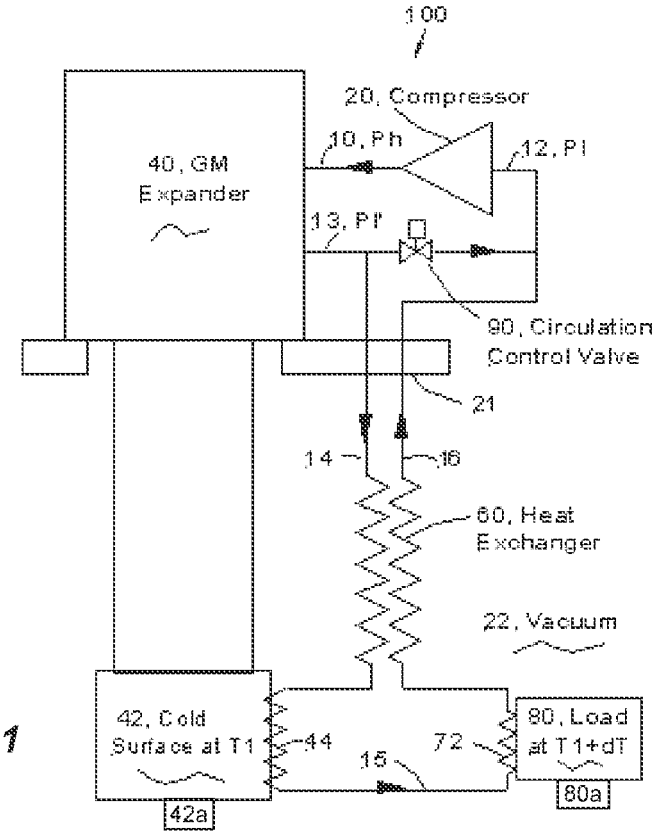
FIG. 1 is a schematic diagram of a cryogenic refrigeration system which is an embodiment that circulates some or all of the gas at low pressure to cool a remote load after it leaves the cold head and before it returns to the compressor.

In this section, some embodiments of the invention will be described more fully with reference to the accompanying drawings, in which preferred embodiments of the invention are shown. This invention, however, may be embodied in many different forms and should not be construed as limited to the embodiments set forth herein. Rather, these embodiments are provided so that this disclosure will be thorough and complete, and will convey the scope of the invention to those skilled in the art. Parts that are the same or similar in the drawings have the same numbers and descriptions are usually not repeated.

Embodiments provide a system of cooling a load, by circulating helium, that operates at cryogenic temperature and is remote from a Gifford-McMahon (GM) or GM type pulse tube cold head (expander). With reference to FIG. 1, shown is cryogenic refrigeration system 100 which provides refrigeration to a remote load 80 by arranging a circulation loop in series with the cold head 40. Specifically, compressor 20 provides helium flow at high pressure and ambient (room) temperature to flow directly through line 10 into the warm end of cold head (expander) 40. Cold head 40 is operated to admit helium gas at high pressure, to expand the gas and provide refrigeration at cold surface 42, and to exhaust the gas at a first lower pressure Pl' and near ambient (room) temperature into line 13. Part or all of the helium flow exhausting from cold head 40 flows into the circulating loop through line 14, the balance returns to compressor 20 through circulation control valve 90 and line 12 at return pressure Pl. The circulating loop arranged in series with the cold head is that portion of the system containing the flow entering line 14 and leaving line 16.

Helium entering the circulation loop through line 14 flows through the supply side of recuperative heat exchanger 60 where it is cooled by the opposing helium flow to a temperature close to the cold operating temperature of the circulating loop. Helium flows from the supply side of recuperative heat exchanger 60 to heat exchanger 44 where it is further cooled by refrigeration provided at cold surface 42 of cold head 40. The circulating helium then flows through line 15 to heat exchanger 72 which cools remote load 80. From there it returns through heat exchanger 60, where it cools the supply side helium, then through line 16 to join with line 12 and return to the compressor 20 at pressure Pl. Lines 14 and 16 pass through warm flange 21 which separates the components that operate in room ambient and those that are cold and insulated by vacuum, 22. Most GM and GM type pulse tube cryogenic refrigerators are designed to operate in ambient temperatures between 10° C. and 40° C. but some may be designed to operate outside that range.

Helium pressure in lines 10 and 12 at the compressor are typically in the range of 2 to 3 MPa and 0.5 to 1 MPa, respectively. The pressure difference across circulation control valve 90 is typically about 0.1 MPa when the system is at its operating temperature but will be higher during cool down or warm up. Circulation control valve 90 adjusts the pressure drop, dP, between the outlet of the cold head in line 13, which is at Pl' (Pl+dP), and line 12, which is at Pl, at compressor 20. Increasing the pressure drop drives more flow through the circulation loop and reduces the refrigeration rate of cold head 40. The advantage of active control can be seen when the cryogenic refrigeration system is used to cool down a remote load from room temperature. When the remote load 80 is warm (near room temperature), pressure loss in the circulating loop is relatively high because the gas has a lower density and higher viscosity than when it is cold. Refrigeration is also relatively high because the thermal losses in cold head 40 are low. By reducing the flow through circulation control valve 90, flow through the circulating loop is increased and the temperature difference dT between cold surface 42 at T1 and load 80 at T1+dT is minimized. The first fraction of gas that is circulating is cooled at cold surface 42 and is said to transport refrigeration to load 80 as it is warmed there. Temperature sensors 42*a* and 80*a* measure the temperatures at these two locations respectively.

By actively controlling circulation, using circulation control valve 90, flow through the circulating loop and flow through cold head 40 can be optimized for a given set of operating conditions. Measurements of flow, temperature, pressure, differential pressure, or a combination of these may be used to inform the flow control decisions of circulation control valve 90.

A preferred method is to use a controller (not shown) to adjust circulation control valve 90 to minimize the temperature difference between sensors 42*a*, and 80*a*. The locations and types of the sensors are not limited to temperature sensors 42*a* and 80*a* as shown in FIG. 1, but can be any locations and types of sensors to effectively detect pressure, temperature and/or an amount of flow of gas in the circulation loop. The amount of the fraction of gas flowing through the circulation loop may be determined to minimize the temperature of the remote load 80 or to maximize a cooling rate at which the remote load 80 cools down.

Figure 2:
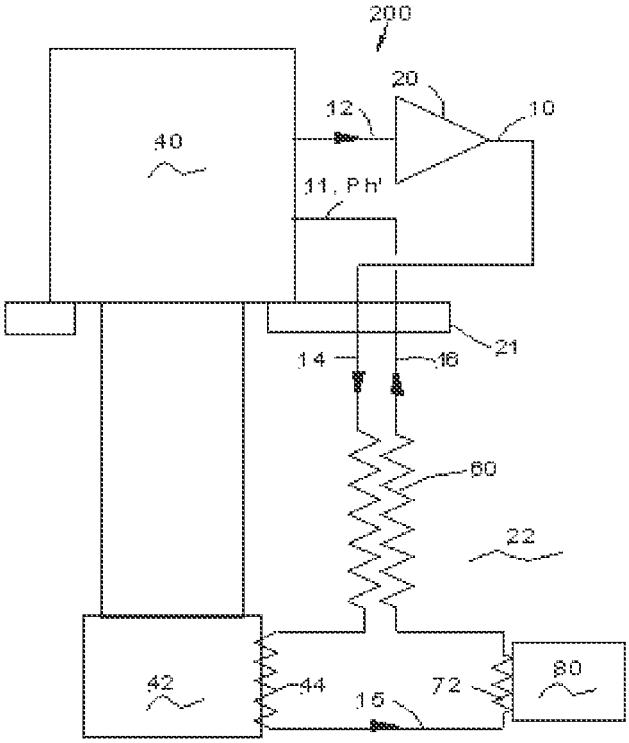
FIG. 2 is a schematic diagram of a cryogenic refrigeration system which is an embodiment that circulates all of the gas at high pressure to cool a remote load after it leaves the compressor and before it returns to the cold head.

With reference to FIG. 2, shown is cryogenic refrigeration system 200 which differs from system 100 in circulating gas from compressor 20 at high pressure to remote load 80 before it enters cold head 40. Gas at low pressure returns directly from cold head 40 to compressor 20 through line 12. While system 200 also may have circulation control valve 90 as shown in FIG. 1, FIG. 2 shows circulating all of the flow from compressor 20. Whether circulating gas at high pressure or low pressure, the system can have a circulation control valve 90 as shown for system 100 (see also FIG. 4), or may have none as shown for system 200. Gas leaves compressor 20 through line 10 at Ph and returns to cold head 40 through line 11 at Ph', the difference dP being the pressure drop in the circulation loop. The circulation loop is typically designed to have a pressure drop dP that is less than about 10% of Ph−Pl.

An example is given of cooling a load at 80 K using a GM refrigerator that produces 600 W of cooling at 80 K but produces about 10 W/K less below 80 K with 10 g/s flow at 2.0/0.8 MPa at cold surface 42. It is preferred that the circulation loop be designed to have a low pressure drop, for example, less than 0.1 MPa, and high heat exchanger efficiency.

Figure 3:
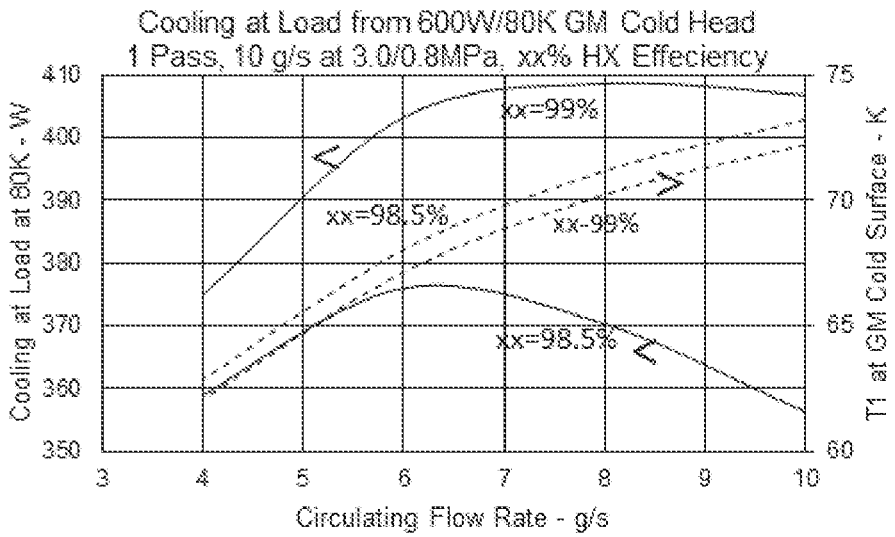
FIG. 3 is a plot of an example of the cooling available at a remote load as a function of the circulating flow rate and heat exchanger efficiency for a one pass loop.

With reference to FIG. 3, shown is a plot of the cooling available at 80 K at the remote load 80 as a function of the circulation rate and for heat exchanger efficiencies of 98.5% and 99%. Circulating gas to cool a remote load 80 at 80 K requires the gas to be cooled to less than 80 K. FIG. 3 also shows the temperature of cold surface 42, assuming that the gas is cooled to that temperature. For a circulation flow rate of 6 g/s and heat exchanger 60 efficiency of 98.5% there is a maximum of 375 W of cooling available at remote load 80, assuming no losses other than heat exchanger 60. The two main sources of losses are 105 W in the heat exchanger, and 120 W reduction in cooling capacity because expander 40 is operating at 68 K. For a heat exchanger efficiency of 99% the optimum circulation flow rate is about 8 g/s. The heat exchanger loss is 94 W and expander 40 is operating at 70.2 K with a reduction in cooling capacity of 98 W leaving W available to cool remote load 80. If circulation control valve 90 is closed and all of the flow goes through the circulation loop the cooling available at load 80 is 404 W. The designer may choose not to have circulation control valve 90 and circulate all the flow.

The flow rates that minimize the temperature difference between cold surface 42 and load 80 in the previous example can be obtained using a controller (not shown) that adjusts the circulating flow rate using circulating control valve 90.

Figure 4:
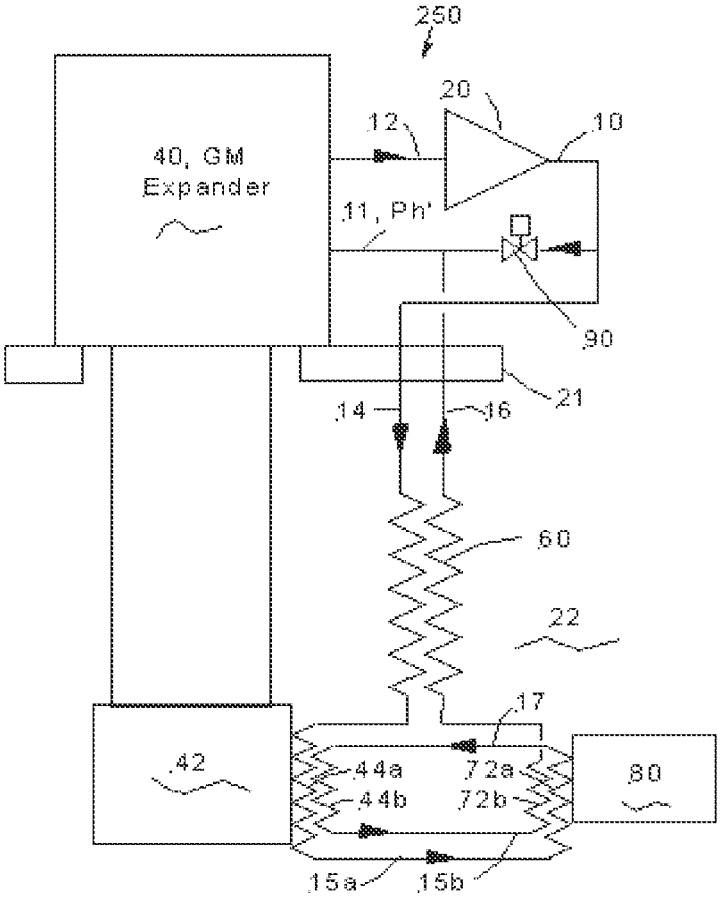
FIG. 4 is a schematic diagram of a cryogenic refrigeration system which is an embodiment that circulates some or all of the gas at high pressure to cool a remote load after it leaves the compressor and before it returns to the cold head. The circulating gas flows twice between the cold head and load before returning to the heat exchanger.
Figure 5:
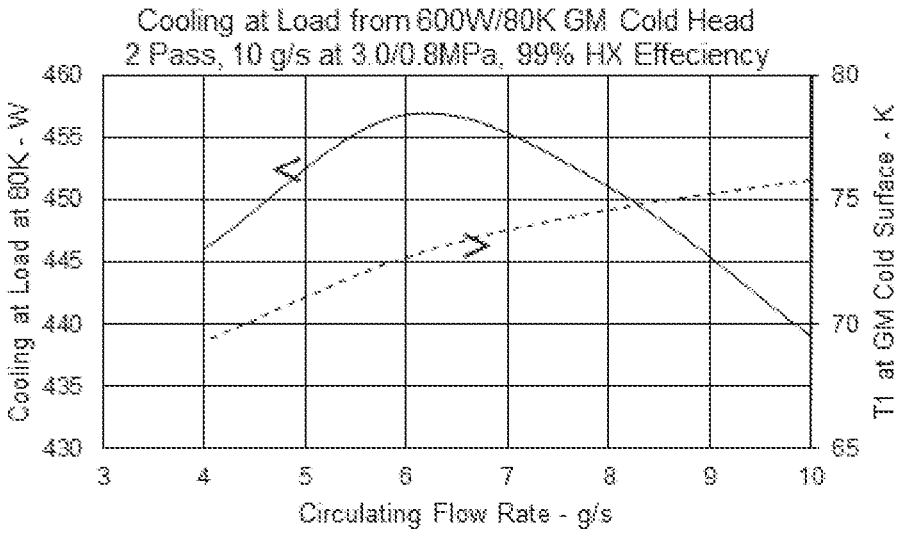
FIG. 5 is a plot of an example of the cooling available at a remote load as a function of the circulating flow rate and heat exchanger efficiency for a two pass loop.

With reference to FIG. 4, shown is cryogenic refrigeration system 250 which has circulation control valve 90 and has a "two pass" circulation loop between cold surface 42 and remote load 80, comprising first pass heat exchangers 44*a* and 72*a* connected by line 15*a* and second pass heat exchangers 44*b* and 72*b* connected by return line 17 and line 15*b*. FIG. 5 is a plot of the available cooling from system 250 for heat exchanger 60 having an efficiency of 99% and the same assumptions as FIG. 3. The optimum circulation flow rate is near 6 g/s for which the heat exchanger loss is 71 W and the reduction in cooling capacity because the expander is at 72.7 K is 73 W, leaving 457 W available to cool remote load 80.

Figure 6:
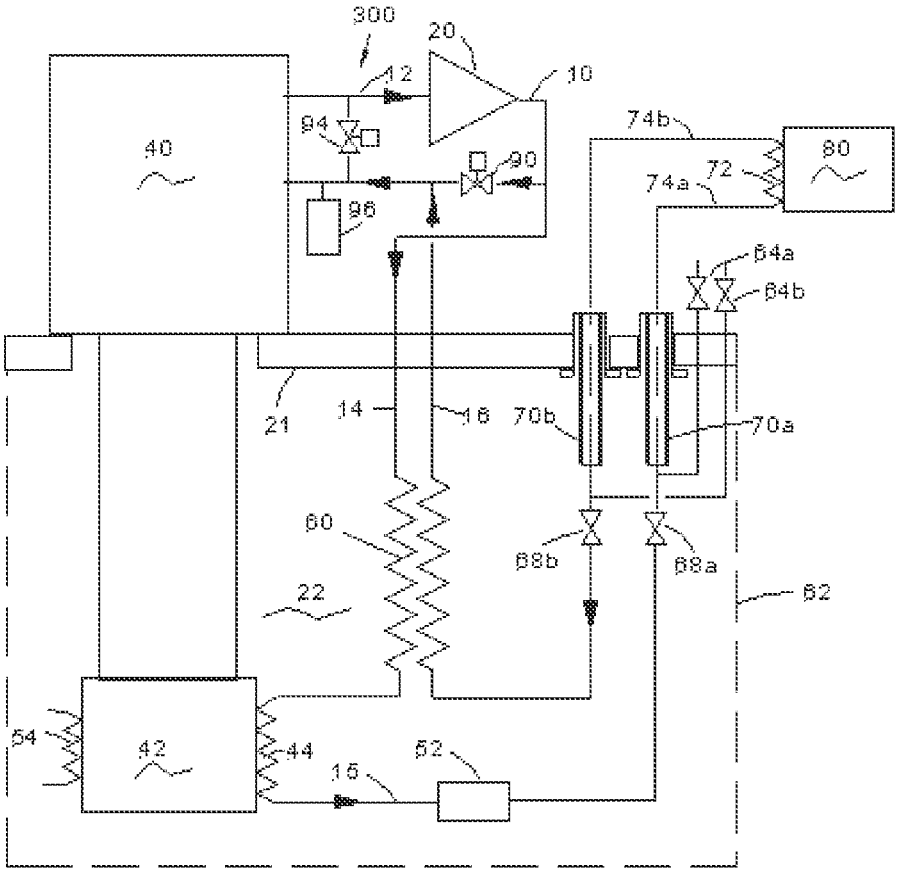
FIG. 6 is a schematic diagram of a cryogenic refrigeration system which illustrates a number of different ways that any of the embodiments can be adapted to cool and warm remote loads.

With reference to FIG. 6, shown is a schematic of cryogenic refrigeration system 300 which shows how the basic circulation system can be adapted to different applications. The circulation loop is shown at high pressure, as in system 200, but the adaptations can equally well be applied to system 100 which is shown circulating gas at low pressure.

Many applications have a need to warm up the load as part of a process or for maintenance. Some GM and GM type pulse tubes can be "run in reverse" and produce heating rather than cooling. These need no modification to systems 100 and 200. For cold heads that cannot be run in reverse a heater 54, that will heat the gas in line 15, and subsequently load 80, requires that gas be circulating and by-passing the cold head. By-pass valve 94 enables gas to circulate while cold head 40 is turned off.

It is common for the cold components of a cryogenic refrigerator to be contained in their own vacuum housing 62, and to circulate gas to a remote load 80 through vacuum insulated (or jacketed) transfer lines 74*a* and 74*b*. The transfer lines can be removeably connected using bayonets 70*a* and 70*b*, or share a common vacuum 22, with the refrigerator. Remote load 80 can be cooled by heat exchanger 72 or by flowing gas through the load. One concern with cooling a remote load 80 by circulating gas that flows through the load is keeping the gas clean. Isolation valves 68*a* and 68*b* when closed enable the gas in the refrigerator to be kept clean while connecting a remote load 80. After connections to the remote load are made, it is necessary to clean the circuit. This is typically done by charging and venting the lines through valves 64*a* and 64*b*. Adsorber 52 can be added to line 15 to help keep the gas clean. As the system cools down, gas can be added through valve 64*a* or 64*b*.

System 300 includes buffer volume 96 between circulation control valve 90 and cold head 40. The buffer volume 96 serves to smooth the flow entering the cold head. In the case of system 200, it would be added to line 11. Options that are not shown or discussed previously include using more than one cold head, operating more than one compressor in parallel, using multistage cold heads that would have two or more cold surfaces and circulate gas to remote loads at different temperatures, operating the cold head at different speeds, adding a gas storage system that allows gas to be added or removed from the system, or using other gases such as neon, argon, or nitrogen.

The terms and descriptions used herein are set forth by way of illustration only and are not meant as limitations. Those skilled in the art will recognize that many variations are possible within the spirit and scope of the invention and the embodiments described herein.

What is claimed is:

1. A cryogenic refrigeration system that circulates gas to a remote load, comprising:

a compressor compressing a gas from a low pressure to a high pressure;

at least one Gifford-McMahon (GM) or GM type pulse tube cold head receiving all of the gas at ambient temperature and at high pressure from said compressor through a first line and returning all of said gas near ambient temperature and at low pressure to the compressor through a second line, producing refrigeration at one or more cold surfaces of the GM or GM type pulse tube; and a circulation loop transporting the refrigeration from said one or more cold surfaces of the GM or GM type pulse tube to a remote load, wherein the circulation loop is configured such that either (i) the circulation loop is connected only to the second line, wherein all or a fraction of said gas from the second line flows though the circulation loop to transport the refrigeration to the remote load and returns to the second line, or (ii) the circulation loop is connected only to the first line, wherein all or a fraction of said gas from the first line flows though the circulation loop to transport the refrigeration to the remote load and returns to the first line.

2. The cryogenic refrigeration system in accordance with claim 1 wherein one of said first and second lines has a circulation control valve that is controlled by a controller which is connected to sensors.

3. The cryogenic refrigeration system in accordance with claim 1 further comprising a recuperative heat exchanger in said circulation loop located between ambient temperature and the temperature of said one or more cold surfaces.

4. The cryogenic refrigeration system in accordance with claim 3 further comprising isolation valves that isolate lines connected to the remote load from other parts of the system.

5. The cryogenic refrigeration system in accordance with claim 4 further comprising one or more ports configured to add or remove gas in the lines connected to the remote load.

6. The cryogenic refrigeration system in accordance with claim 1 wherein the circulation loop further comprises a second pass that returns circulating gas from the remote load back to the one or more cold surfaces then back to the remote load.

7. The cryogenic refrigeration system in accordance with claim 1 wherein the cold head has two cold surfaces at different temperatures.

8. The cryogenic refrigeration system in accordance with claim 1 wherein the gas is one or more selected from a group consisting of helium, neon, nitrogen, and argon.

9. The cryogenic refrigeration system in accordance with claim 1 further comprising one or more buffer volumes in communication with the cold head for smoothing gas flow pulsations.

10. The cryogenic refrigeration system in accordance with claim 1 further comprising bayonet connections between the remote load and the one or more cold surfaces.

11. The cryogenic refrigeration system in accordance with claim 1 further comprising vacuum jacketed transfer lines between the remote load and the one or more cold surfaces.

12. A method of cooling a remote load by using a cryogenic refrigeration system that circulates gas to a remote load, the system comprising:

a compressor compressing a gas from a low pressure to a high pressure;

at least one GM or GM type pulse tube cold head receiving all of the gas at ambient temperature and at high pressure from said compressor through a first line and returning all of said gas near ambient temperature and at low pressure to the compressor through a second line, producing refrigeration at one or more cold surfaces of the GM or GM type pulse tube; and a circulation loop transporting the refrigeration from said one or more cold surfaces of the GM or GM type pulse tube to a remote load, wherein the circulation loop is configured such that either (i) the circulation loop is connected only to the second line, wherein all or a fraction of said gas from the second line flows though the circulation loop to transport the refrigeration to the remote load and returns to the second line, or (ii) the circulation loop is connected only to the first line, wherein all or a fraction of said gas from the first line flows though the circulation loop to transport the refrigeration to the remote load and returns to the first line;

wherein one of said first and second lines has a circulation control valve which diverts a first fraction of the gas to flow through the circulation loop;

the method comprising;

adjusting the circulation control valve to control the cooling of the remote load.

13. The method of claim 12 where an amount of the first fraction of the gas is determined based on at least one of measured pressure, temperature, or an amount of flow in the lines at high pressure and low pressure.

14. The method of claim 12 where an amount of the first fraction of the gas is determined to minimize temperature of the remote load.

15. The method of claim 12 where an amount of the first fraction of the gas is determined to maximize a cooling rate at which the remote load cools down.

* * * * *